US010941624B2

(12) United States Patent
Gerhardt et al.

(10) Patent No.: US 10,941,624 B2
(45) Date of Patent: Mar. 9, 2021

(54) DRILL STRING ELEMENT

(71) Applicant: HERRENKNECHT AG, Schwanau (DE)

(72) Inventors: Tobias Gerhardt, Teningen (DE); Michael Lubberger, Schwanau (DE); Tobias Engel, Gundelfingen (DE)

(73) Assignee: HERRENKNECHT AG, Schwanau (DE)

( * ) Notice: Subject to any disclaimer, the term of this patent is extended or adjusted under 35 U.S.C. 154(b) by 193 days.

(21) Appl. No.: 15/555,940

(22) PCT Filed: Mar. 4, 2016

(86) PCT No.: PCT/EP2016/000378
§ 371 (c)(1),
(2) Date: May 18, 2018

(87) PCT Pub. No.: WO2016/146241
PCT Pub. Date: Sep. 22, 2016

(65) Prior Publication Data

US 2018/0245413 A1 Aug. 30, 2018

(30) Foreign Application Priority Data

Mar. 15, 2015 (DE) ..... 10 2015 003 157.0

(51) Int. Cl.

| | |
|---|---|
| ***E21B 21/10*** | (2006.01) |
| ***E21B 7/04*** | (2006.01) |
| ***E21B 17/10*** | (2006.01) |
| ***E21B 21/00*** | (2006.01) |
| ***E21B 17/00*** | (2006.01) |
| ***E21B 34/06*** | (2006.01) |

(52) U.S. Cl.
CPC ..... *E21B 21/103* (2013.01); *E21B 7/046* (2013.01); *E21B 17/00* (2013.01); *E21B 17/10* (2013.01); *E21B 21/00* (2013.01); *E21B 34/06* (2013.01)

(58) Field of Classification Search
CPC ..... E21B 21/103
USPC ..... 166/316
See application file for complete search history.

(56) References Cited

U.S. PATENT DOCUMENTS

| | | | | |
|---|---|---|---|---|
| 2,634,101 | A | 4/1953 | Sloan | |
| 3,237,705 | A * | 3/1966 | Williams, Jr. | E21B 10/26 175/406 |
| 3,306,378 | A | 2/1967 | Edward, Jr. | |
| 4,583,603 | A | 4/1986 | Dorleans | |
| 5,407,020 | A | 4/1995 | Beavers | |
| 5,911,285 | A | 6/1999 | Stewart | |
| 6,769,498 | B2 | 8/2004 | Hughes | |
| 8,813,873 | B2 | 8/2014 | Beardmore et al. | |
| 2014/0209292 | A1* | 7/2014 | Watson | F04D 29/086 166/105 |

* cited by examiner

*Primary Examiner* — Taras P Bemko
(74) *Attorney, Agent, or Firm* — Mark Rodgers

(57) ABSTRACT

A drill string element of a drill string, the drill string element configured to keep the pressure in the annular space between the drill string and the drill hole within calculated limits or to keep the pressures prevailing in the annular space or drill string as small as possible. Settled drill cuttings are brought back into the flow or settlement of the drill cuttings is prevented.

6 Claims, 5 Drawing Sheets

DRILL STRING ELEMENT

Figure 1:
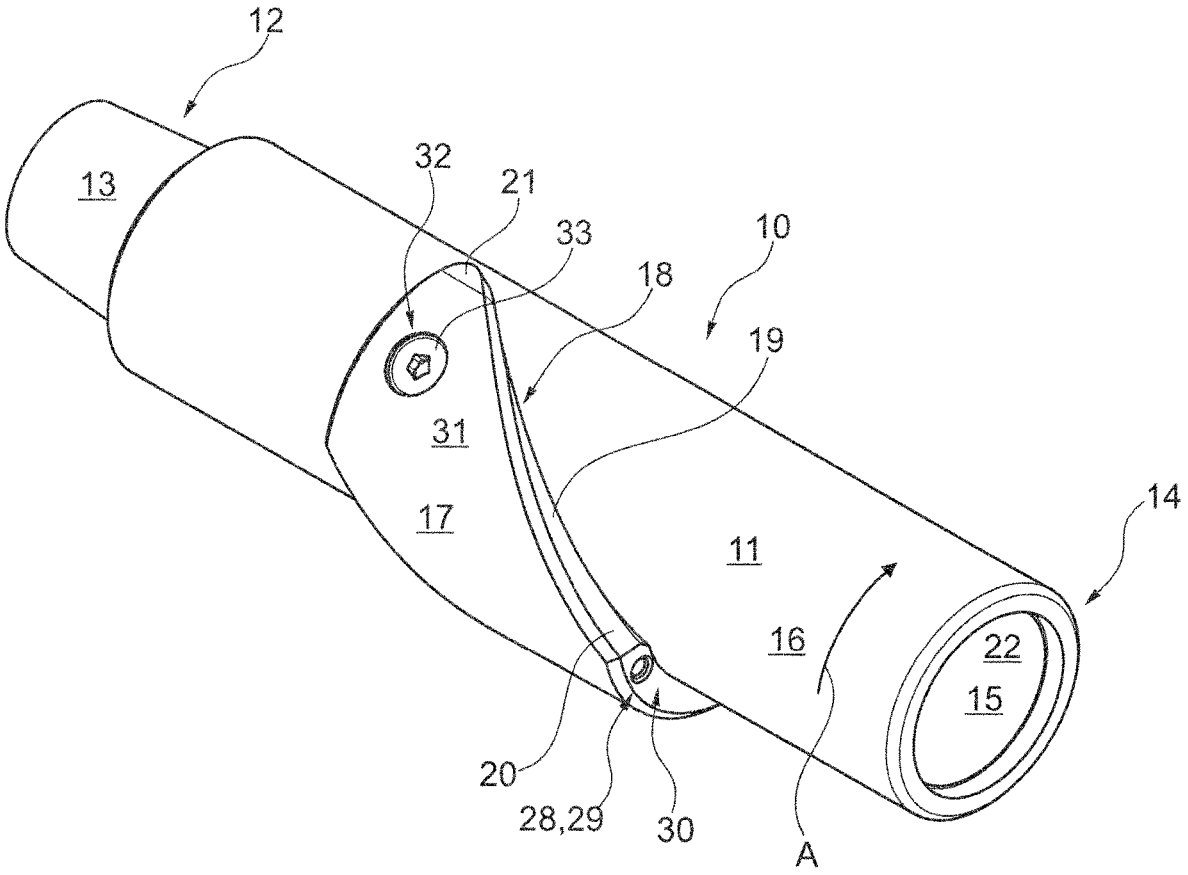

The invention relates to a drill string element for installing in a drill string, in particular for horizontal or slant directional drilling (HDD or SDD), for the creation of a drill hole along a drill path, in particular for laying a pipeline, comprising a tubular main body having bilateral connecting elements for connecting the drill string element to the drill string, wherein the drill string element has an interior through which a flushing medium for the flushing of the drill hole and the evacuation of drill cuttings loosened by a drill head connected to the drill string is transportable, comprising at least one opening, connected to the interior, in a wall of the main body, through which at least a part of the flushing medium flowing through the interior makes its way into an annular space between drill hole wall and main body.

EP 0 360 321 discloses a drilling and laying method (Horizontal Directional Drilling), in which, for the trenchless laying of a pipeline under an obstacle along a predefined drilling line, a pilot hole is created with a drill head and a drill string from a start point to a destination point. By rotation of the drill string, the drill head is driven. After this, a reamer, which is connected to the pipeline to be laid, is attached to the pilot hole string on the destination side. By rotation of the drill string, the reamer is driven. An advancement of the reamer, with simultaneous drawing-in of the pipeline, is realized by withdrawal of the pilot drill string.

In pilot drilling with the HDD method, the pilot drill head is pushed along by means of drill rods in a controlled manner, following the planned route. A drilling suspension is pumped, by means of an opening leading through the drill pipe, to the pilot drill head. There the drill cuttings removed from the pilot drill head mix with the drilling suspension. This suspension then flows with the drill cuttings through the bored drill hole back to the start point or entry point of the drilling. Since the diameter of the drill head is not substantially larger than the outside diameter of the drill rods, an annular space is present between drill hole and drill rod. In this annular space is formed a flow, with which the drill cuttings are conveyed out of the drill hole.

Due to the shape of the flow channel in the annular space, there are zones in which the flow velocity approaches zero, in these zones entrained drill cuttings are deposited, a so-called drill cuttings bed is formed. The consequence of these deposits is an increased torque of the rotating drill string as a result of friction against the drill cuttings bed on the bottom of the drill hole. Moreover, the free flow cross section diminishes, the flow velocity rises and thereby generates higher pressure losses during the backflow to the start side of the drilling. These pressure losses must be compensated by the mud pump, which results in an increased pressure level upon exit of the drilling suspension at the pilot drill head. The higher mud pressure at the outlet of the mud at the drill head can in turn lead to a fracturing of the rock, depending on the bedrock or the nature thereof. This has the result that undefined mud paths can be formed, generally perpendicular to the horizontal drilling axis, directly to the surface, at which mud paths the drilling mud then escapes in an uncontrolled manner.

Apart from the environmental aspect of an undefined escape of mud, the drilling must also be interrupted, since a controlled discharge of the drill cuttings is no longer possible. A so-called mud blowout can be repaired again only with effort, by the addition of additives into the drilling fluid or the cementing of the blowout site.

In practice, critical mud pressures are generally calculated in advance, in that existing geological data are overlaid with a pressure calculation. The maximum values must not be exceeded. By pressure sensors behind the drill head, the pressures can be measured and monitored.

The object of the invention is to provide a drill string element and a drill string comprising the same, with which it becomes possible to keep the pressure in the annular space beneath the calculated limits or to keep the pressures prevailing in the annular space or drill string as small as possible by, for instance, by settled drill cuttings being brought back into the flow or by settlement of the drill cuttings being prevented.

The object according to the invention is achieved according to a first solution with respect to the drill string element by virtue of the fact that on the outer wall, over the opening, is arranged at least one body, in which is disposed, at least in part, a flow channel, that the flow channel has at least one flow path and is fluidically connected to the opening via an inlet opening, that the flow channel, on its side facing away from the opening, has at least one outlet opening, and that the clear cross section of the opening and/or inlet opening is smaller or larger than the clear cross section of the outlet opening.

The provision of two different clear cross sections, in which the clear cross section of the opening and/or inlet opening is smaller than the clear cross section of the outlet opening, makes it possible in a particularly simple manner to provide a low pressure level at the nozzle outlet. This ensures a lower flow velocity of the flushing medium at the point of exit. The exit of the flushing medium is hence less aggressive. In the event of a high pressure level in the interior of the drill string, and thus at the nozzle outlet, there is the danger of the drill hole being widened by the escaping flushing medium. It has thus unexpectedly been shown that it is thus possible in a particularly simple manner to introduce the escaping flushing medium gently into the annular space.

The provision of two different clear cross sections, in which the clear cross section of the opening and/or inlet opening is larger than the clear cross section of the outlet opening, makes it possible in a particularly simple manner to provide a higher pressure level at the nozzle outlet. This ensures a greater flow velocity of the flushing medium at the point of exit. The exit of the flushing medium is hence more aggressive. This can be used in particular when drill cuttings are to be deliberately swirled up locally at selected points, at the same time as the rock in which the drill hole is made or the stone of the drill hole wall is of such nature that, in the event of a high pressure level in the interior of the drill string, and thus at the nozzle outlet, there is no danger of the drill hole being widened by the escaping flushing medium.

A further teaching of the invention provides that the clear cross section of the opening, the inlet opening and/or the outlet opening is adjustable. As a result, the desired parameters of the flushing medium can be regulated/adjusted particularly easily.

A further teaching of the invention provides that in the opening, the inlet opening, within the flow channel, and/or in the outlet opening is arranged at least one nozzle and/or orifice plate, wherein preferredly at least one nozzle and/or orifice plate is designed to be changeable. By means of a nozzle/orifice plate, the desired delivery parameters are able to be provided particularly easily. Through a change of nozzle(s), the parameters desired at the operating point of the drill string element can be adjusted particularly easily. As a result, different pressure levels within the drill pipe are equalized in a particularly simple manner in dependence on the drilling length A further teaching of the invention provides that the outlet opening is arranged in a rear-end side face of the body. The outlet opening is here advantageously arranged on the rear side face such that the drilling suspension leaving the outlet opening drill cuttings, which have been taken up by a receiving and transport surface on the body and leave this same at the rear end 20, are entrained by the drilling suspension which escapes there, and thus are fed back to the general flow of the drilling suspension in the annular space 102 and are accordingly transported out of the drill hole 100 in the flow direction B.

A further teaching of the invention provides that the outlet opening is arranged substantially axially to the center axis of the drill string element. As a result, the flushing medium is delivered along the drill string, which leads to a movement of the drill cuttings, in particular if they have settled. Furthermore, a widening of the drill hole through direct influencing of the flushing medium on the drill hole wall is avoided.

A further teaching of the invention provides that the at least one body, preferredly the one body, extends on the main body, so that the outside radius of the main body is enlarged in some sections, and an eccentric is present, by which the drill string can be periodically raised in the course of the drilling. The eccentrically designed drill string element leads, with each revolution, to a raising of the drill string. As a result of the raising, the flow cross section in the upper region of the drill hole is reduced, which leads to flowing of the drilling fluid along the drill hole bottom. Deposited drill cuttings are thereby transferred back to the drilling fluid.

A further teaching of the invention provides that on the body is provided a side face, which is designed as a receiving and transport surface for drill cuttings settled on a bottom of the drill hole, wherein the side face is preferredly designed helically in relation to the drill hole axis. As a result, the settled drill cuttings are taken up and transferred back to the drilling fluid.

A further teaching of the invention provides that in the body, above the opening and/or the inlet opening, is arranged an access opening, in which preferredly a blind flange is provided as the closure element. It hereby becomes possible in a particularly simple manner to perform the changing of the nozzle/orifice plate or the adjustment of this same.

The object according to the invention is achieved according to a further solution with respect to the drill string element by virtue of the fact that on the outer wall is arranged at least one body, which extends on the main body, so that the outside radius of the main body is enlarged in some sections and an eccentric is present, by which the drill string can be periodically raised in the course of the drilling in relation to the bottom of the drill hole. The eccentrically designed drill string element leads, with each revolution, to a raising of the drill string. As a result of the raising, the flow cross section in the upper region of the drill hole is reduced, which leads to flowing of the drilling fluid along the drill hole bottom. As a result, deposited drill cuttings are rinsed again by the fluid medium and thereby make their way again into the drilling fluid.

A further teaching of the invention provides that the at least one body is constituted by precisely one or by two bodies, preferredly lying one opposite the other.

A further teaching of the invention provides that at least one opening, connected to the interior, is provided in a wall of the main body, through which at least a part of the flushing medium flowing through the interior makes its way into an annular space between drill hole wall and main body, that over the opening is arranged the body, in which is disposed, at least in part, a flow channel, that the flow channel has at least one flow path and is fluidically connected to the opening via an inlet opening, that the flow channel, on its side facing away from the opening, has at least one outlet opening, and that the clear cross section of the opening and/or inlet opening is smaller than the clear cross section of the outlet opening.

A further teaching of the invention provides that the clear cross section of the opening, the inlet opening and/or the outlet opening is adjustable. A further teaching of the invention provides that in the opening, the inlet opening, within the flow channel, and/or in the outlet opening is arranged at least one nozzle and/or orifice plate, wherein preferredly at least one nozzle and/or orifice plate is designed to be changeable. A further teaching of the invention provides that the outlet opening is arranged substantially axially to the center axis of the drill string element. A further teaching of the invention provides that on the body is provided a side face, which is designed as a receiving and transport surface for drill cuttings settled on a bottom of the drill hole, wherein the side face is preferredly designed helically in relation to the drill hole axis.

It should additionally be stated that the wording "and/or" should be construed as both an "and" and an "or" linkage of the appropriate features.

Figure 2:
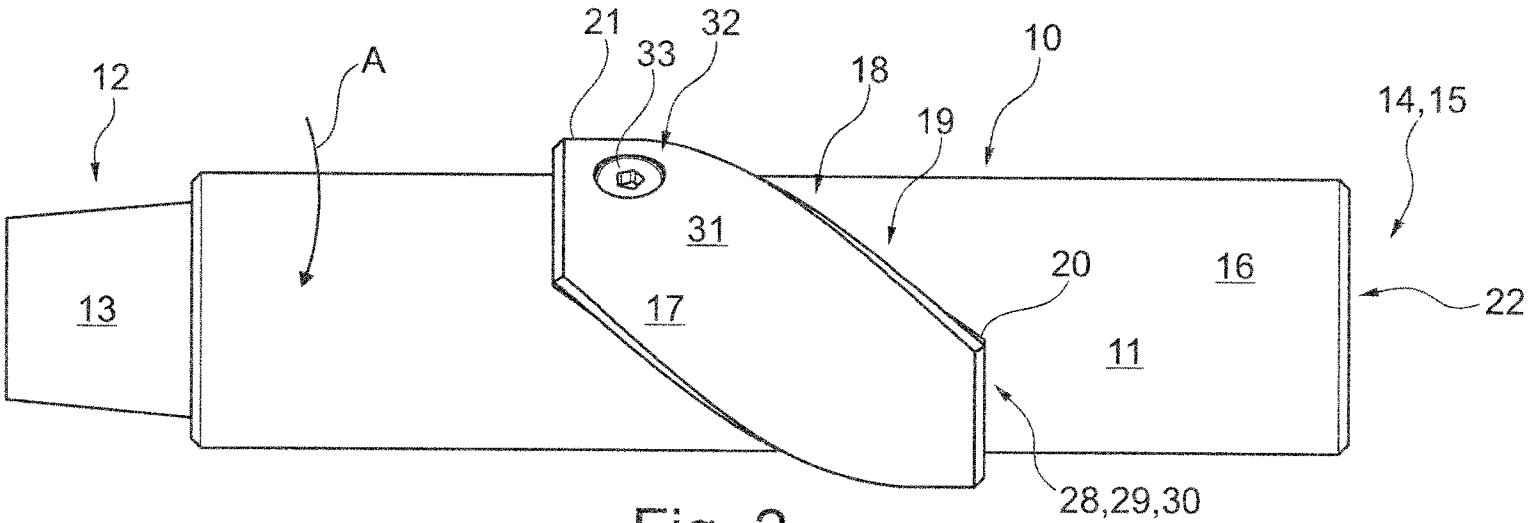
Figure 3:
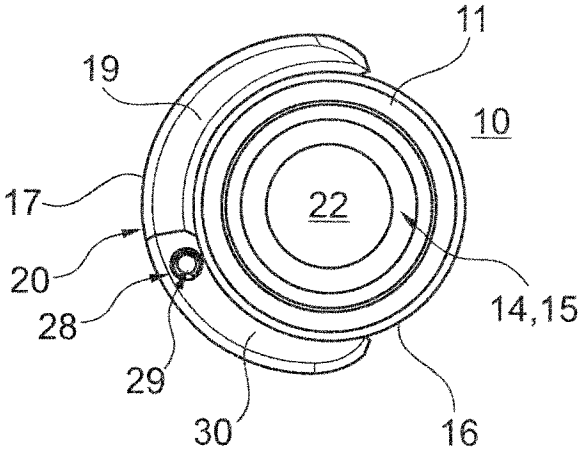
Figure 4:
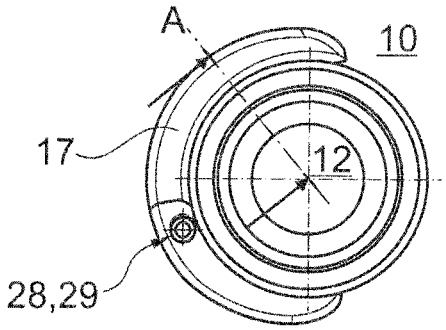
Figure 5:
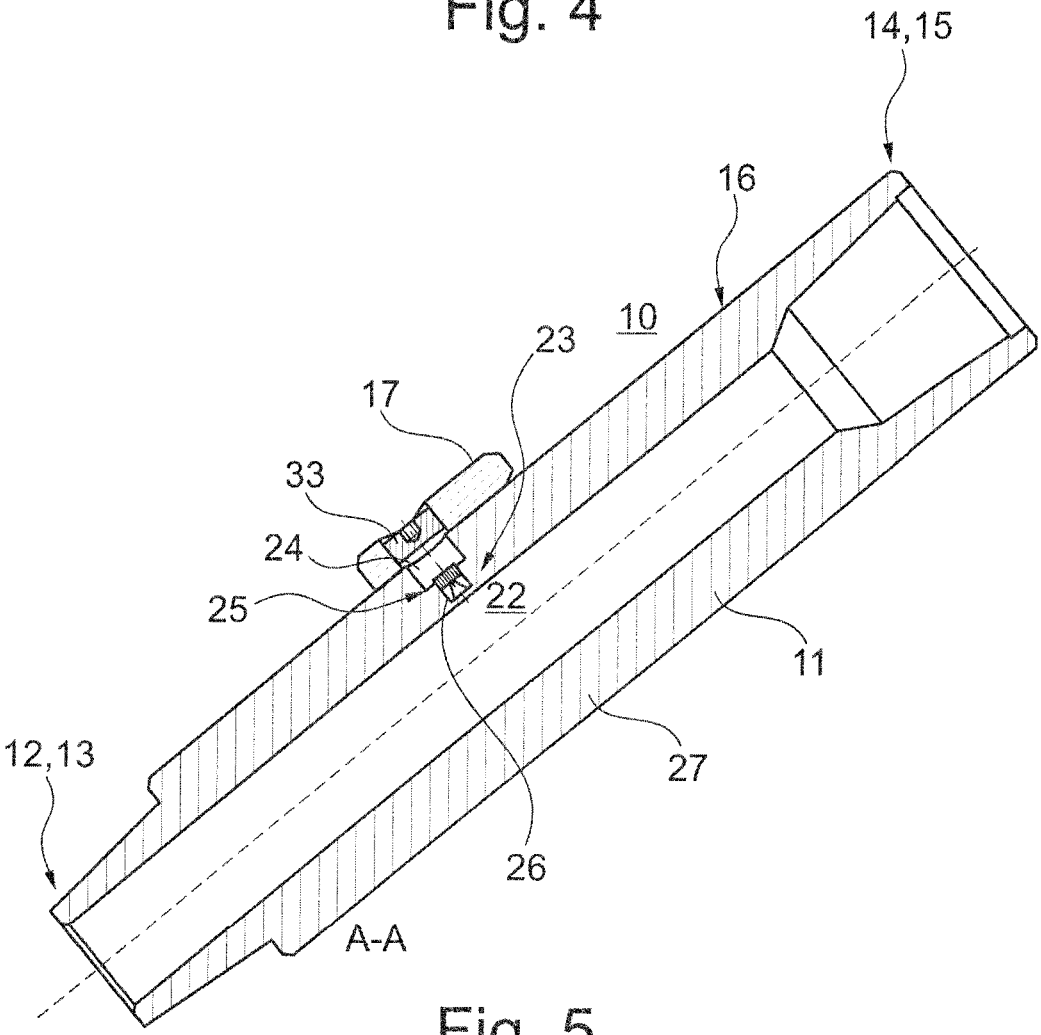
Figure 6:
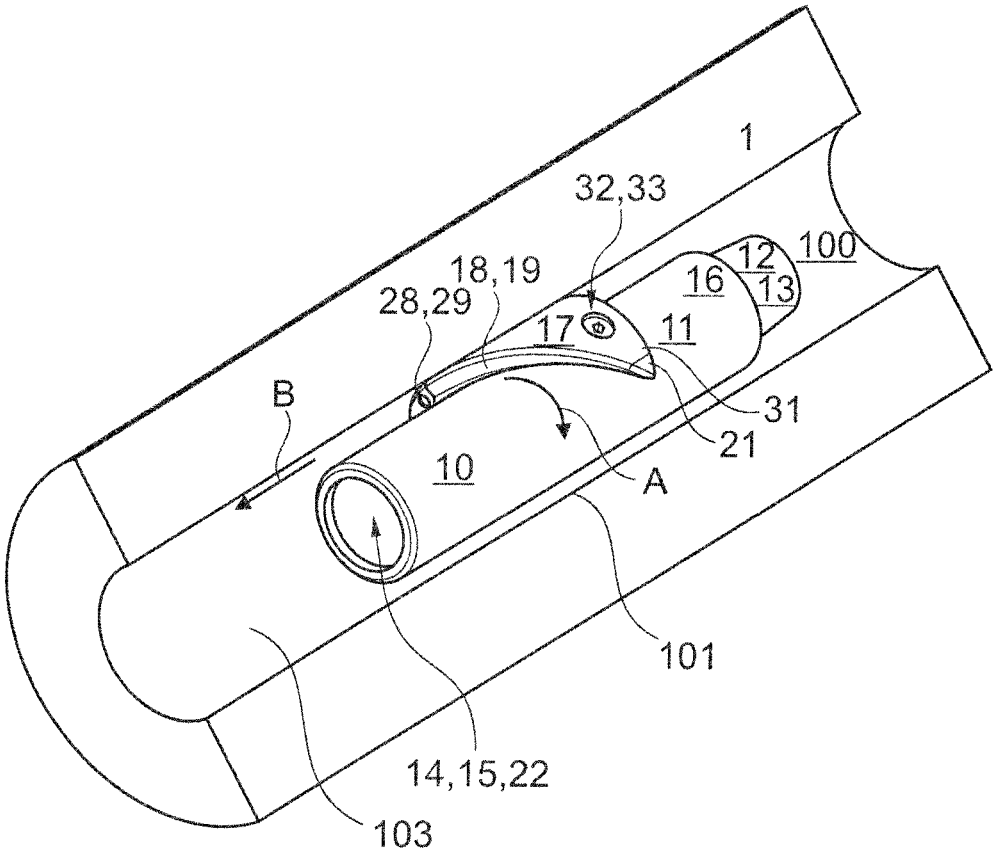
Figure 7:
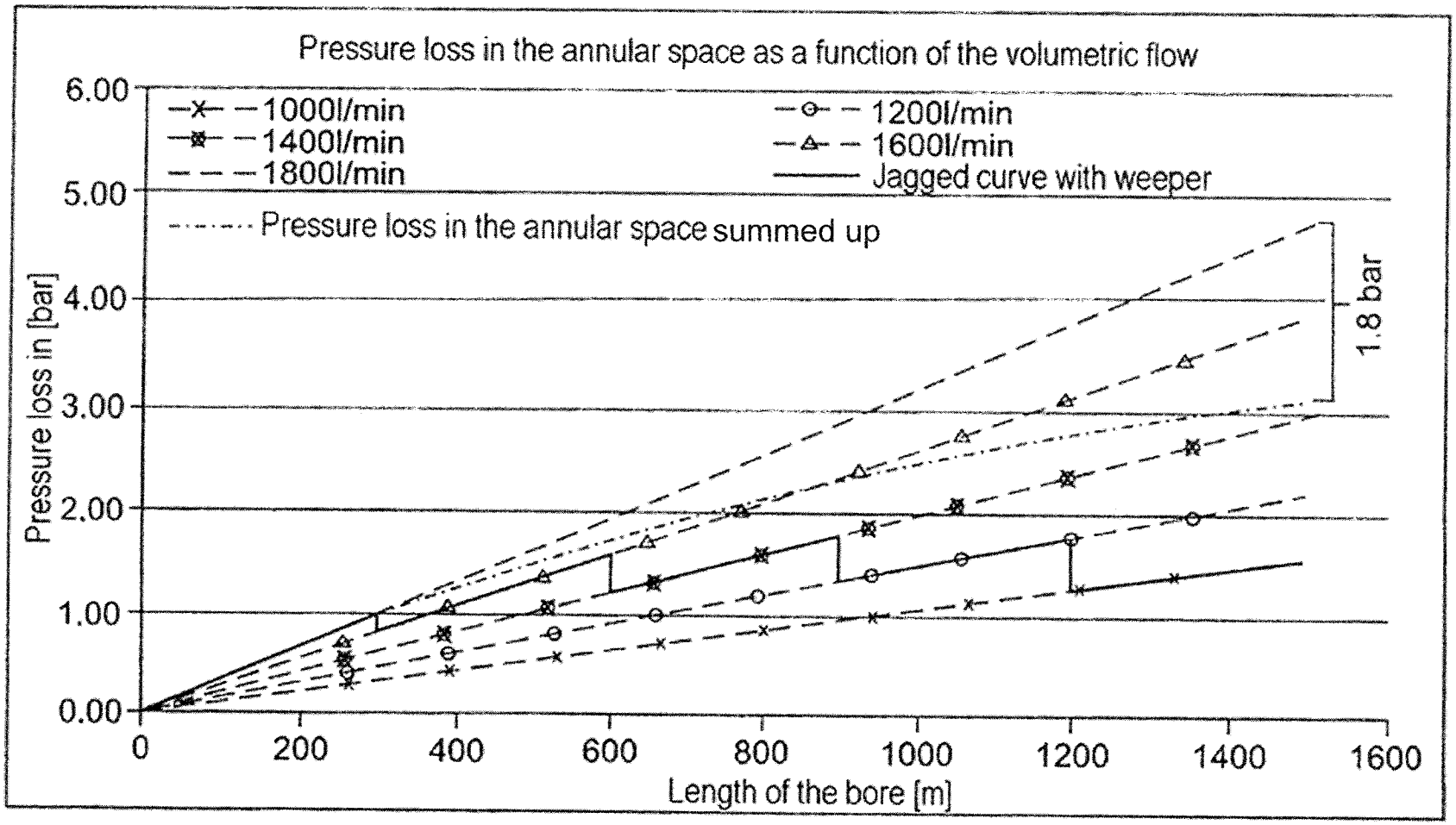

The solutions of the invention are described in greater detail below on the basis of a preferred illustrative embodiment in conjunction with a further drawing, in which:

FIG. 1 shows a first three-dimensional view of a drill string element according to the invention, FIG. 2 shows a three-dimensional side view with reference to FIG. 1, FIG. 3 shows a three-dimensional view of the bottom side with reference to FIG. 1, FIG. 4 shows a view with reference to FIG. 3 with marked sectional view, FIG. 5 shows a sectional view of a drill string element according to the invention according to FIG. 1, sectioned as indicated in FIG. 4, FIG. 6 shows a three-dimensional view of a drill string element according to the invention in a drill hole portrayed in sectioned representation, and FIG. 7 shows a graph of the pressure losses in the annular space as a function of the volumetric flow or the drilling length.

FIG. 1 to FIG. 6 show a drill string element 10 according to the invention, comprising a main body 11, which is of tubular design. The main body 11 has at its front end 12 a male connecting element 13 and at its rear end 14 a female connecting element 15, which are respectively provided with corresponding threads (not represented).

On the outer wall 16 of the main body 11 is arranged a body 17, which is of helical design. In the preferred illustrative embodiment, the body 17 is welded onto the main body 11. It is also possible, however, to arrange said body on the main body 11 through the use of other types of connection known to the person skilled in the art. The body 17 has on its side face 18 a receiving and transport surface 19, with which, upon rotation of the drill string (rotational direction A), and thus also upon the rotation of the drill string element 10, the drill cuttings (not represented) on a bottom 101 of a drill hole 100 in an annular space 102 between outer wall 16 of the main body 11 and a drill hole wall 103 are taken up by the receiving and transport surface 19 from the drill hole bottom 101 and, along the receiving and transport surface 19, upon the rotation of the drill rod element 10, are moved away from the bottom 101 until the drill cuttings have arrived at the rear end 20 of the receiving and transport surface 19, at which end the drill cuttings leave the receiving and transport surface 19 and are fed back to the flowing drilling fluid medium in the flow direction B, so as to be evacuated from the drill hole 100 through the annular space 102. The take-up of the drill cuttings takes place at the tip 21 of the receiving and transport surface 19.

The main body 11 has an interior 22, as is represented in FIG. 5. Through the interior 22, drilling fluid is transported from the pump (not represented) to the drill head (not represented) counter to the flow direction B. At the drill head, the drilling suspension exits and receives the drill cuttings loosened by the drill head and transports them through the annular space 102 in the flow direction B or out of the drill hole 100. In order to be able to specifically increase the volumetric flow in the annular space 102, in the main body 11 is provided an opening 23, which opens out into a flow channel 24. The flow channel 24 has an inlet opening 25, which is aligned with the opening 23. Alternatively, the possibility exists that the inlet opening 25 and the opening 23 have different clear cross sections. In the opening 23 is provided a nozzle 26, which defines the clear cross section of the opening 23 and, in this case, of the inlet opening 25.

The flow channel 24 extends within the wall 27 of the main body 11 and/or in the body 17 as far as an outlet opening 28. In the outlet opening 28 is likewise arranged a nozzle 29, which defines the clear cross section of the outlet opening 28. Alternatively, instead of the nozzles, orifice plates can also be provided.

The outlet opening 28 is arranged in a rear-end side face 30 of the body 17. The arrangement is here provided axially to the drill hole middle. An inclination relative thereto in the radial direction is likewise possible, for instance if the drill hole wall is not loosened by the delivered jet of the drilling suspension.

The inlet opening 25 or the flow channel 24 in the region of the inlet opening 25 extends as far as the top side 31 of the body 17 in order to provide an access to the inlet opening 25 or opening 23, via which access the nozzle 26 is exchangeable. In this access opening 32 is arranged a blind flange 33. This is removable in order to be able to change the nozzle 26.

The outlet opening 28 with the nozzle 29 is here arranged on the rear side face 30, so that the drilling suspension leaving the nozzle 29 the drill cuttings which have been taken up by the receiving and transport surface 19 and leave the same at the rear end 20, are entrained by the drilling suspension which escapes there, and thus are fed back to the general flow of the drilling suspension in the annular space 102 and are accordingly transported out of the drill hole 100 in the flow direction B.

If a plurality of drill string elements 10 are arranged in a drill string, it is possible to equip each/a plurality of the drill string elements 10 with an individual nozzle fitting consisting of the nozzles 26 and 29, in order then respectively to adapt the delivery of the drilling suspension in the drill hole 100 to the individual installation sites.

Through the provision of a plurality of drill string elements 10 in the drill string, the volumetric flow in the annular space is increased locally at selected points. This is represented in FIG. 7 by the jagged curve. It is hereby possible to reduce the pressure losses in the annular space, which then leads to a situation in which all in all, at the drill head, less volumetric flow has to be introduced into the annular space, whereby the pressure losses fall and the pump capacity can be reduced.

Starting from the drill head, the volumetric flow in the annular space 102 at each drill string element 10 is increased by the previously set volumetric flow. The jagged curve represented in FIG. 7 serves merely for guidance purpose in order to illustrate at what point a drill string element 10 was respectively installed in the drill string. The pressure losses are unable to be read off from this curve.

In the example represented in FIG. 7, drill string elements 10 were inserted in the drill string 4 to give a total drilling length of 1,500 meters. The clear cross sections/nozzles 26, 29 of the individual drill string elements 10 were here chosen/set such that, at each drill string element 10, respectively 200 liters per minute are delivered at the outlet openings 28. At the drill head itself, a volumetric flow of 1,000 liters per minute is present. This produces a volumetric flow in the sum of 1,800 liters per minute. It has surprisingly been shown that, according to the curve "summated pressure loss", a pressure difference of 1.8 bar, given a total drilling length of 1,500 m, is obtained in the annular space. The unexpected reduction of almost 2 bar in the annular space considerably reduces the risk of obtaining a blowout. At the same time, wear and tear is considerably reduced and the energy costs are significantly lowered as a result of the reduced pump capacity.

REFERENCE SYMBOL LIST

10 drill string element
11 main body
12 front end
13 connecting element
14 rear end
15 connecting element
16 outer wall
17 body
18 side face
19 receiving and transport surface
20 rear end
21 tip
22 interior
23 opening
24 flow channel
25 inlet opening
26 nozzle
27 wall
28 outlet opening
29 nozzle
30 side face
31 top side
32 access opening
33 blind flange
100 drill hole
101 bottom
102 annular space
103 drill hole wall
A rotational direction
B flow direction in the annular space

The invention claimed is:

1. A drill string element intended for placement in a horizontal directional drilling (HDD) drill string, the drill string intended for the creation of a drill hole along a drill path for laying a pipeline, the drill string element comprising:

bilateral connecting elements for connecting the drill string element to the drill string;

a tubular main body having a wall and an interior through which a flushing medium is transportable which flushes the drill hole and evacuates drill cuttings loosened by a drill head connected to the drill string;

wherein the wall of the tubular main body comprises at least one opening which is connected to the interior, and, at least a part of the flushing medium flowing through the interior passes through the opening into an annular space between a drill hole wall and an exterior of the tubular main body;

at least one further body disposed on the outside face of the wall of the tubular main body over the opening, comprising, at least in part, a flow channel for drilling fluid, the flow channel comprising: at least one flow path with at least one inlet opening and at least one outlet opening, wherein the flow channel is fluidically connected to the opening via the at least one inlet opening;

the at least one outlet opening is disposed in the further body on a side facing away from the opening;

the at least one inlet opening and the at least one outlet opening have an open cross section;

the open cross section of at least one of the opening or inlet opening is at least one of smaller or larger than the open cross section of the outlet opening;

the outlet opening is disposed substantially axially to a center axis of the drill string element configured to direct drilling fluid in a direction that will minimize fluid interaction with the borehole wall;

wherein the further body increases the radius of the drill string in one direction creating an eccentric shape, wherein when the drill string is rotated in the horizontal borehole the eccentric shape forces the drill string to be lifted from the floor of the borehole and cuttings that have settled near the borehole bottom of the borehole are moved back up into the fluid stream in the annulus by the released drilling fluid jet in combination with the upwards movement of the drill string from the bottom of the borehole due to the eccentric shape created by the further body;

wherein;

the open cross section of the outlet opening and at least one of the opening or the inlet opening are adjustable;

at least two of the opening, the inlet opening, the inside the flow channel, or the outlet opening comprise at least one of a nozzle or an orifice plate, and at least one of the nozzle or orifice plate is changeable.

2. The drill string element as claimed in claim 1, wherein the outlet opening is disposed in a rear-end side face of the further body.

3. The drill string element as claimed in claim 1, wherein the further body contains a side face, configured as a receiving and transport surface for drill cuttings settled on a bottom of the drill hole.

4. The drill string element as claimed in claim 3, wherein the side face has a helical form in relation to the center axis.

5. The drill string element as claimed in claim 1, wherein an access opening is disposed in the further body above at least one of the opening or the inlet opening.

6. The drill string element as claimed in claim 5, wherein a blind flange is disposed in the access opening as a closure element.

* * * * *